US008023664B2

(12) United States Patent
Yang

(10) Patent No.: US 8,023,664 B2
(45) Date of Patent: Sep. 20, 2011

(54) RAPID INSTALLATION AND DETACHMENT DEVICE FOR FLUSH MOUNTING SPEAKER ON CEILING OR WALL

(75) Inventor: Chin-Teh Yang, Taipei County (TW)

(73) Assignee: High Hit Enterprises Co., Ltd., Taipei County (TW)

( * ) Notice: Subject to any disclaimer, the term of this patent is extended or adjusted under 35 U.S.C. 154(b) by 747 days.

(21) Appl. No.: 12/163,702

(22) Filed: Jun. 27, 2008

(65) Prior Publication Data

US 2009/0324004 A1 Dec. 31, 2009

(51) Int. Cl.
*H04R 1/02* (2006.01)

(52) U.S. Cl. ..... 381/87; 381/386; 381/395; 181/150

(58) Field of Classification Search ..... 381/395, 381/87, 386; 181/150
See application file for complete search history.

(56) References Cited

U.S. PATENT DOCUMENTS

| | | | | |
|---|---|---|---|---|
| 6,588,543 | B1 * | 7/2003 | Tchilinguirian | 181/150 |
| 6,925,190 | B2 * | 8/2005 | Popken et al. | 381/395 |
| 7,676,045 | B2 * | 3/2010 | Merrey et al. | 381/87 |
| 2004/0047487 | A1 * | 3/2004 | Popken et al. | 381/395 |
| 2007/0121988 | A1 * | 5/2007 | Merrey et al. | 381/386 |
| 2008/0044053 | A1 * | 2/2008 | Belanger et al. | 381/391 |
| 2009/0245567 | A1 * | 10/2009 | Egyud et al. | 381/395 |
| 2009/0324004 | A1 * | 12/2009 | Yang | 381/395 |
| 2010/0040254 | A1 * | 2/2010 | Wright | 381/395 |

* cited by examiner

*Primary Examiner* — Mary Wilczewski
(74) *Attorney, Agent, or Firm* — Schmeiser Olsen & Watts LLP

(57) ABSTRACT

A rapid installation and detachment device for flush mounting speaker on ceiling or wall is composed of a hinge bracket, coil springs, gaiters, press fits, cushion springs and stop blocks. The above mechanisms are driven by the coil springs to rapidly and efficiently install a speaker on the hinge bracket. The detachment of the speaker never damages the surrounding surface material of the ceiling or wall. The device is applicable to all kinds of surface materials with different thickness.

6 Claims, 13 Drawing Sheets

RAPID INSTALLATION AND DETACHMENT DEVICE FOR FLUSH MOUNTING SPEAKER ON CEILING OR WALL

BACKGROUND OF THE INVENTION

1. Field of the Invention

The present invention relates to a rapid installation and detachment device for flush mounting speaker on ceiling or wall. By employing this device, the installation and detachment for a flush mounting speaker on the surface of the ceiling or wall can be performed more rapidly and effectively than any conventional means.

2. Description of the Prior Art

Recently due to booming economic expansion, large scale supermarkets, department stores and the whole-sale plazas are increasing at a great speed around the world. It is necessary for owners to promote their merchandise in every possible way. Among which to install flush mounting loud speakers on the ceiling or wall surface is the most effective and appealing practice even in the public buildings, schools or hospitals. The speaker installed as such looks not only clean and neat, but also is free from danger of accidental destruction.

However, speaking of a flush mounted ceiling speaker, for example, installation work to be carried out in high location is a tedious and time consuming work. Especially when bolt and nut combination is used to fasten the speaker onto the ceiling or wall may lead to destructing the appearance of the surface thereof after the equipment is detached.

For these defects noticeable on the prior art, an improvement is seriously required. The inventor of the present invention has plunged into this matter for years to study and correct these defects, and finally comes up with the present invention.

SUMMARY OF THE INVENTION

Accordingly, it is an object of the present invention to provide a rapid installation and detachment device for flush mounting speaker on ceiling or wall to perform the work in a rapid, clean and neat way by cooperation of the component parts contained in the device.

It is another object of the present invention that this device is applicable to speakers that are in various shapes, sizes and weights, and the ceiling and wall surface materials of various thicknesses.

To achieve the aforesaid objects, the present invention includes a hinge bracket with several guide sleeve bases, a detent groove formed at one side of each guide sleeve base. On the surface of the hinge bracket there are several guide hole bases. The hinge bracket is to carry the whole weight of the installation. A coil spring sleeved over the guide sleeve base is jointed to the detent groove with its one end, and to a detent groove of a gaiter with the other end thereof. The gaiter is sleeved over the coil spring. A notch is formed on the upper surface of the gaiter with a detent groove provided at its side. A helical pawl is jointed to the exterior edge of the gaiter and a fit cap screw set is provided in the gaiter. A press fit covered on the gaiter has a tapped hole formed at each of the two sides thereof with a screw set passing through so as to hold the press fit at the position on the guide hole base of the hinge bracket. A notch is formed at the center surface of the press fit with a tapped hole for the press fit to pass through. A pawl is provided at one bottom edge of the press fit. A cushion spring formed of a flat cap screw set with a compressed spring coiled on it perforates the gaiter and the press fit up and down and then is secured to a stop block. The stop block set on the notch of the press fit has a tapped hole in it, and a pawl extended from lower edge of the both sides thereof so as to form a tenon and mortise joint with the notch on the surface of the gaiter thereby controlling the gaiter at its position before starting turning motion. With this structure, the speaker is settled in the containment hole of the hinge bracket, and then rapidly and efficiently installing the hinge bracket to the holes reserved on the surface of the ceiling or wall with an angle shaped spanner or a hexagonal spanner.

BRIEF DESCRIPTION OF THE DRAWINGS

The drawings disclose an illustrative embodiment of the present invention which serves to exemplify the various advantages and objects thereof, and are as follows.

DETAILED DESCRIPTION OF THE PREFERRED EMBODIMENT

Figure 1:
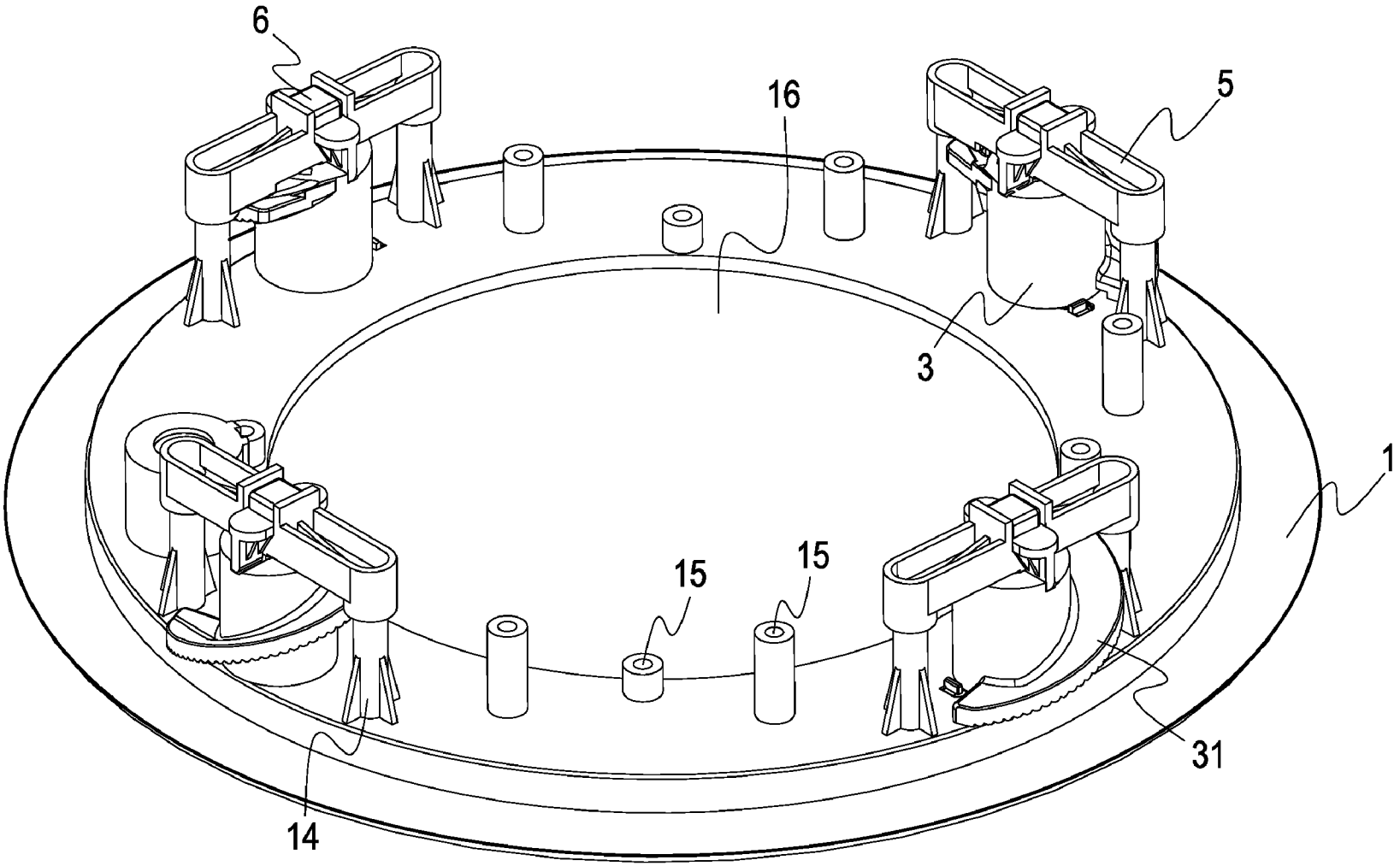
FIG. 1 is a perspective view of the device according to the present invention.
Figure 2:
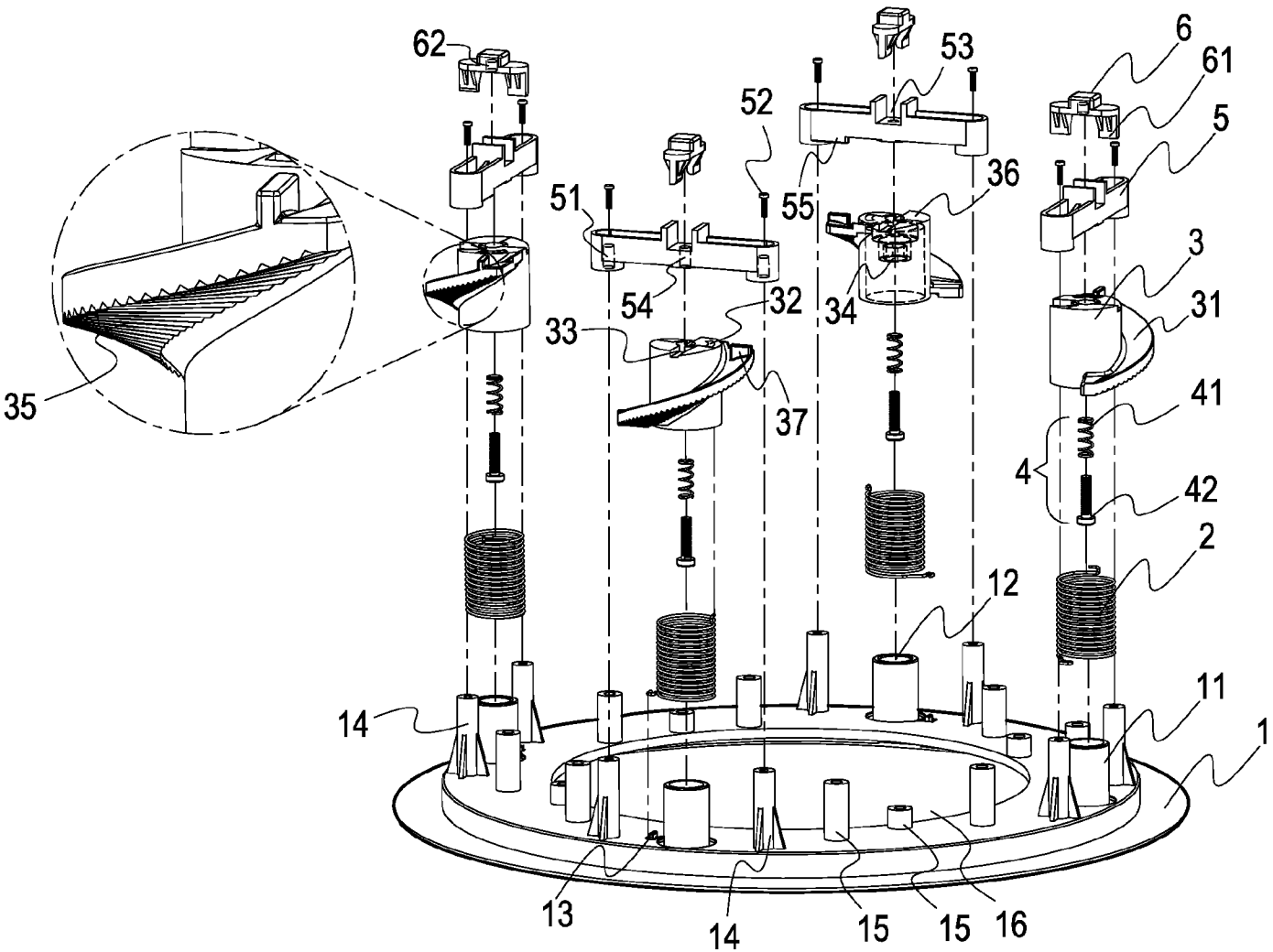
FIG. 2 is an exploded view of the device according to the present invention.
Figure 7A:
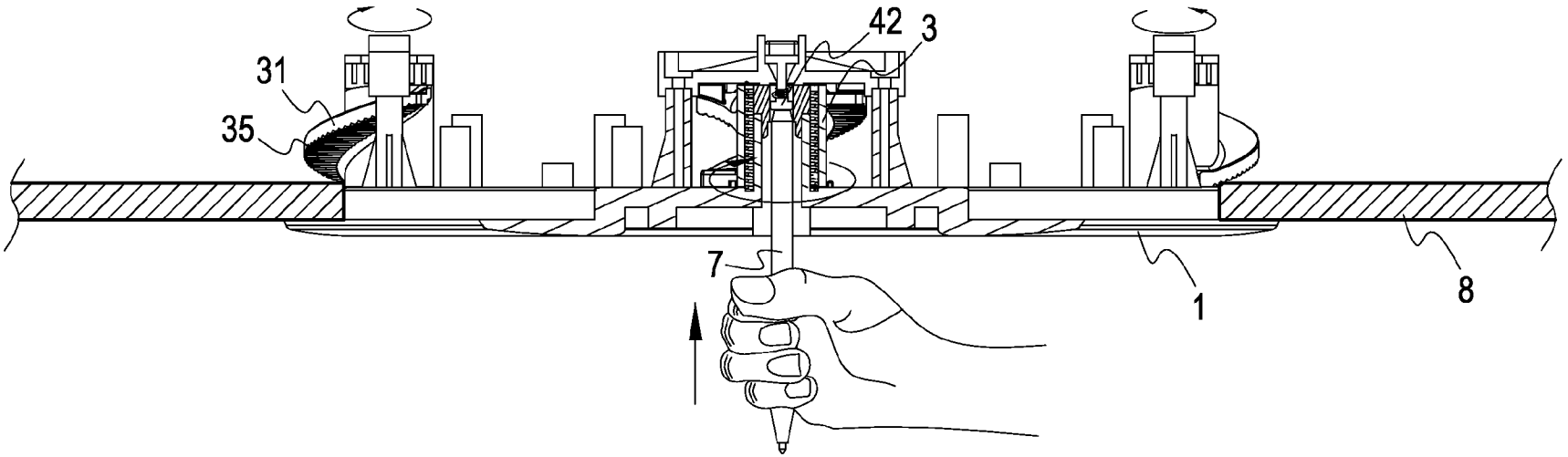
FIG. 7A and FIG. 7B are exemplary views showing that the device can be installed using alternative tools other than the angle shaped spanner.

Referring to FIG. 1, FIG. 2 and FIG. 7A, a rapid installation and detachment device for flush mounting speaker on ceiling or wall according to the present invention can perform the work through cooperation of the component parts contained in the device. The device comprises a hinge bracket 1 with several guide sleeve bases 11 provided on its surface, as shown on FIG. 2. A detent groove 13 formed at one side of each guide sleeve base 11, and guide hole 12 is formed in the guide sleeve base 11 to let the guide sleeve base pass through. On the surface of the hinge bracket 1 there are formed several guide hole bases 14. The hinge bracket 1 is to carry whole weight of the device structure. A coil spring 2 is sleeved over the guide sleeve base 11 and secured its one end to the detent groove 13 of the hinge bracket 1, and the other end to a detent groove 32 of a gaiter 3. The gaiter 3, which is sleeved over the coil spring 2, has a notch 33 on its upper surface and the detent groove 32 is formed at the side of the notch 33 and there is a helical pawl 31 attached to the exterior edge of the gaiter 3. The helical pawl 31 has several grooves 35 formed on its bottom surface that serve to increase gripping force of the pawl 31 with the surface material. There is a guide hole 34 formed inside the gaiter 3. A press fit 5 provided on the gaiter 3 has a tapped hole 51 at each end to let the press fit 5 pass through and fix the press fit 5 at a guide hole base 14 on the surface of the hinge bracket 1 with a screw set 52. There is a notch 53 formed on the central surface of the press fit 5 with a tapped hole 54 to let the press fit 5 pass through. There is a stopper 55 provided at the lower end of the press fit 5. A cushion spring 4 formed of a compressed spring 41 coiled around a flat cap screw unit 42 perforates upwards through the gaiter 3 and the press fit 5 is secured to a stop block 6. The stop block 6, which is settled in the notch 53 of the press fit 5, has a topped hole 62 inside, and a pawl 61 is extended from the lower edge of both sides thereof so as to form a tenon and mortise joint with the notch 33 on the surface of the gaiter 3 thereby controlling the gaiter 3 at its position before turning. A stopper 37 at the upper end of the helical pawl 31 is to trap the stopper 55 provided under the press fit 5 to control the device after starting to operate. An angle shaped spanner 7 is used to efficiently install the flush mounting speaker as shown on FIG. 7A.

Figure 3A:
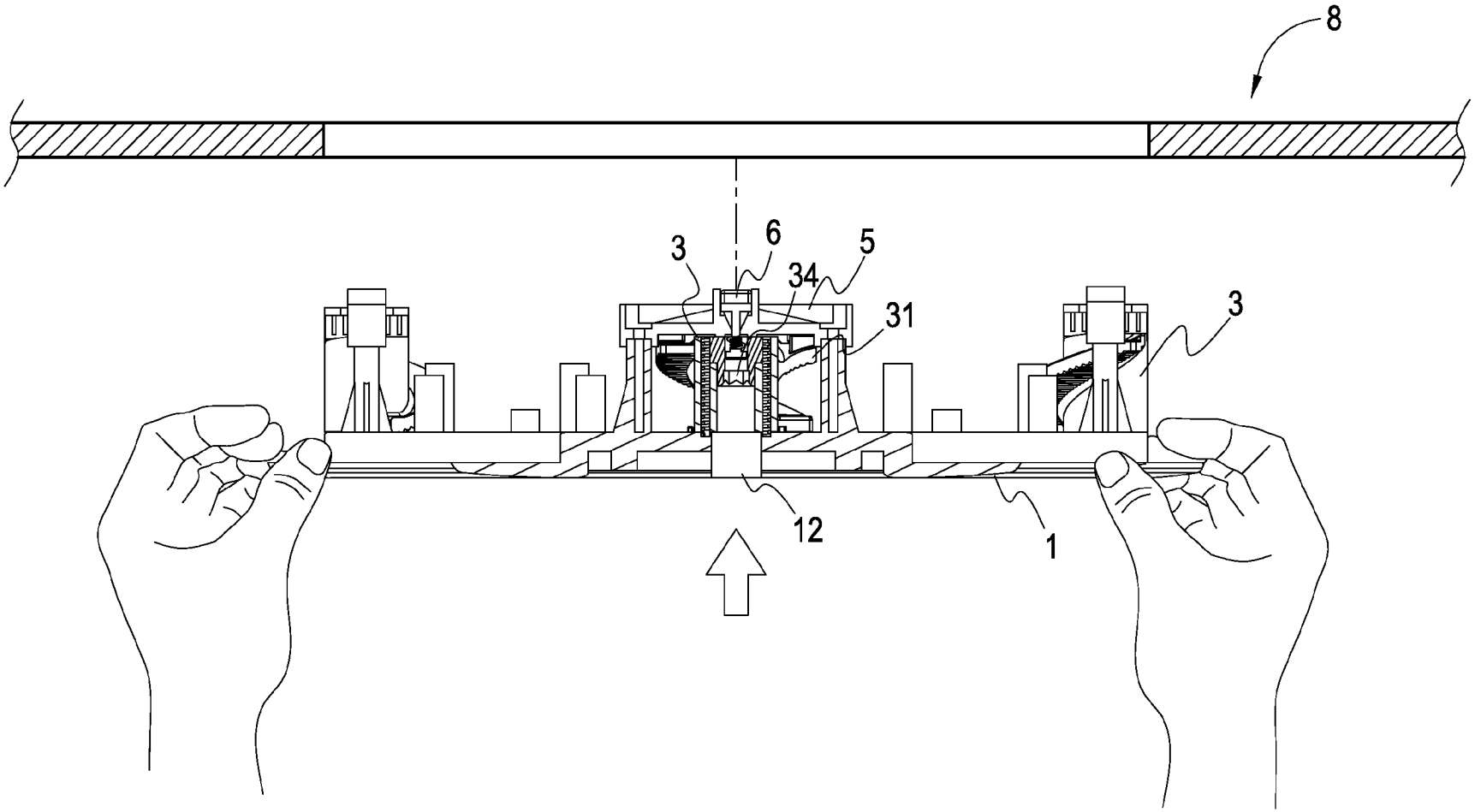
FIG. 3A is a sectional view of FIG. 5A along line A-A.
Figure 3B:
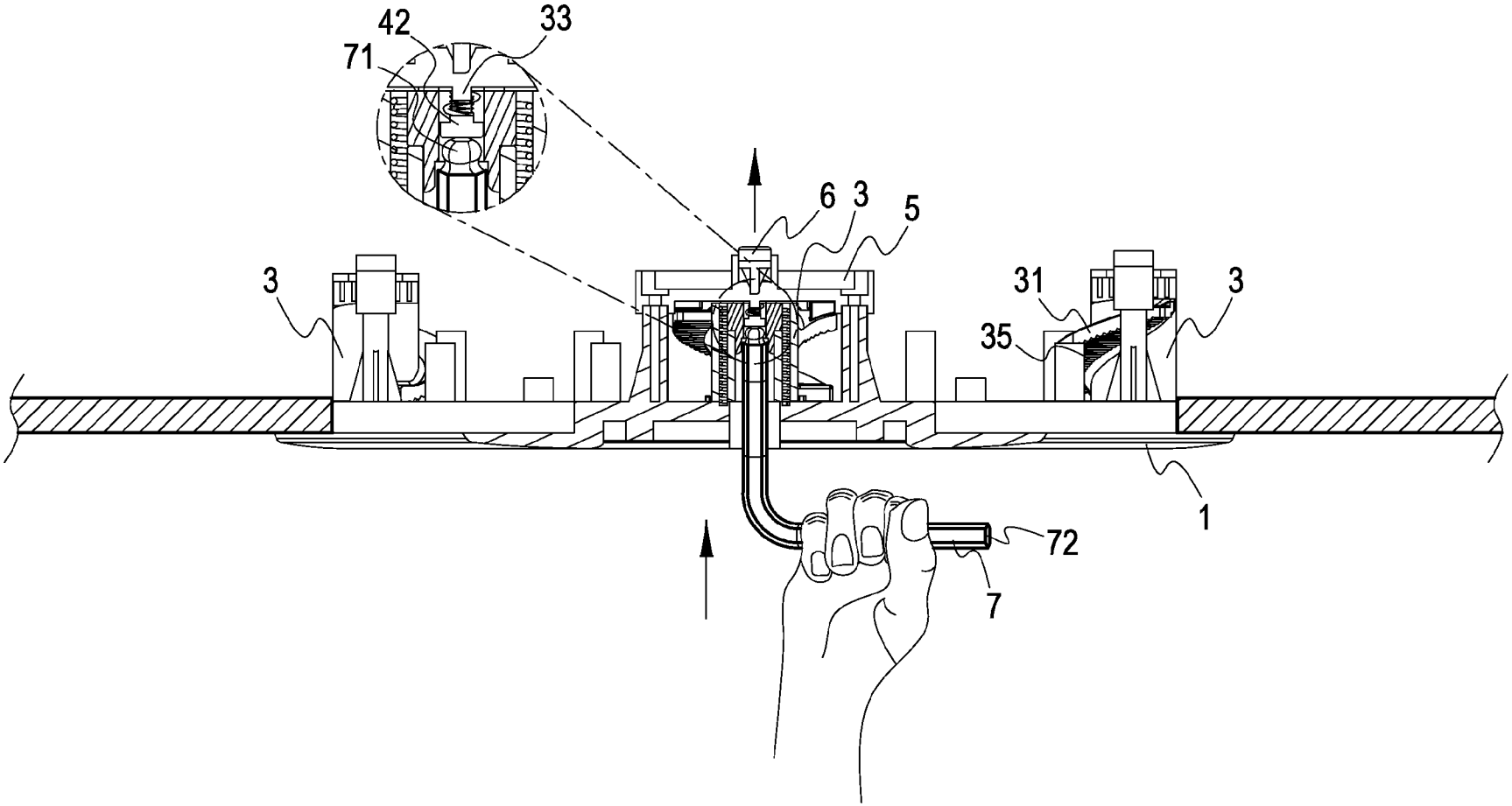
FIG. 3B through FIG. 3C are the illustrative views showing how to settle the device of the present invention.
Figure 3C:
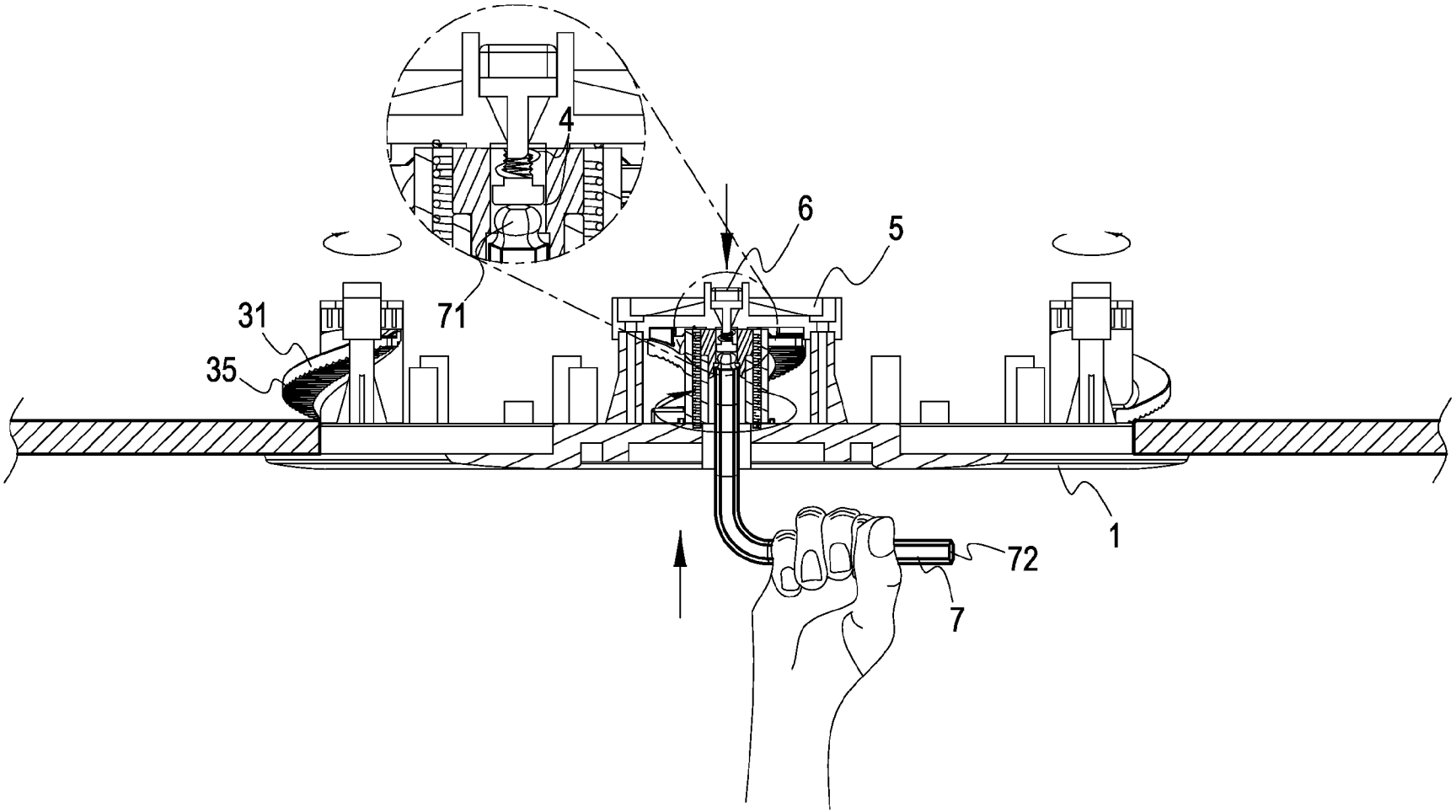
Figure 4A:
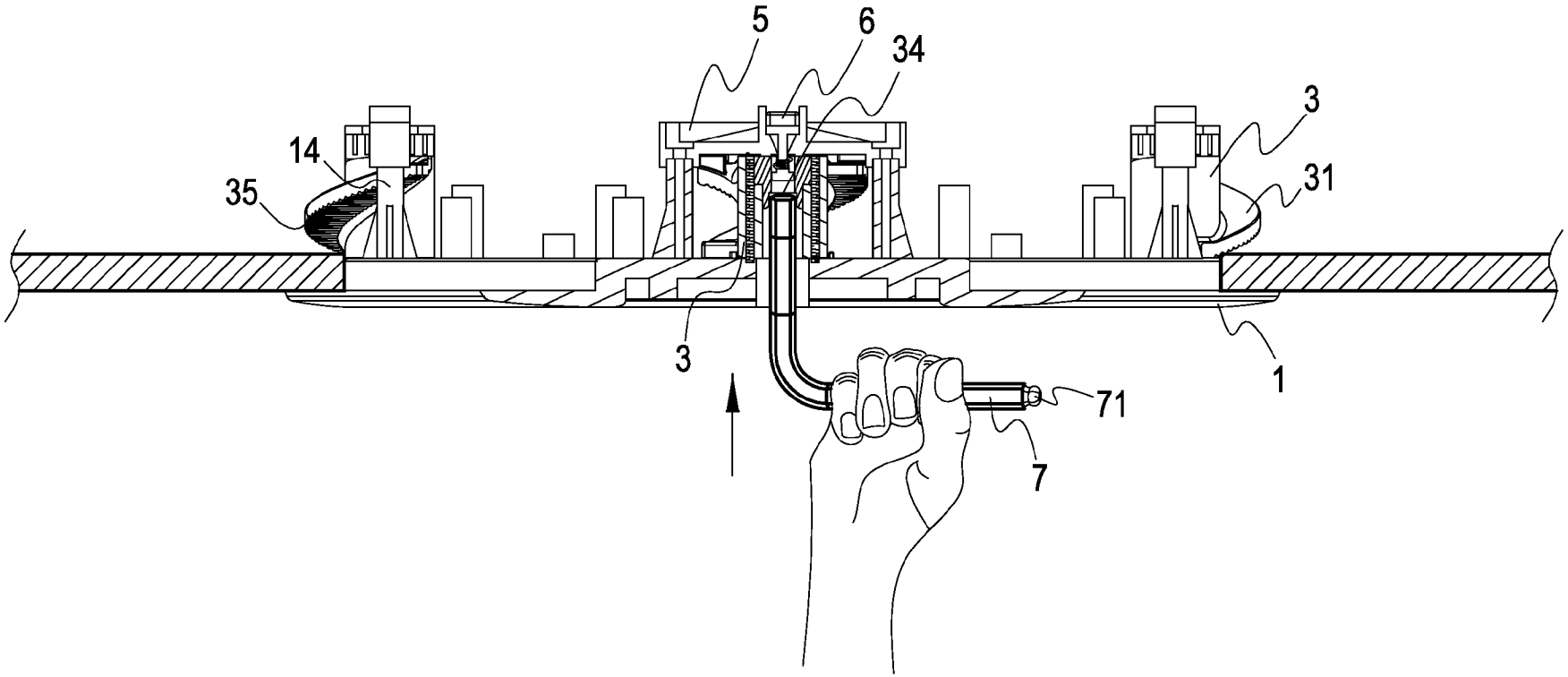
FIG. 4A is a sectional view of FIG. 5B along line B-B.
Figure 4B:
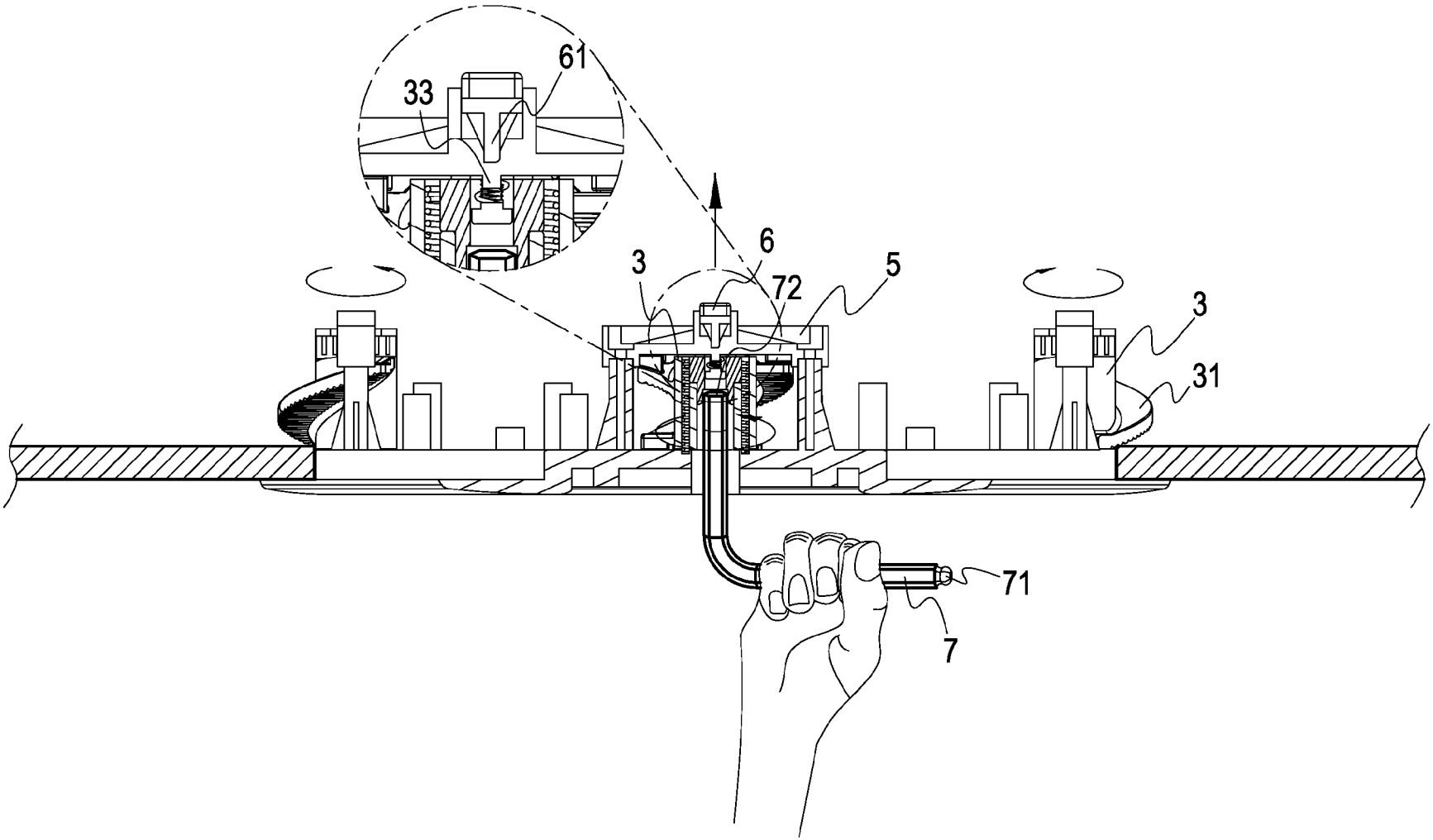
FIG. 4B through FIG. 4C are the illustrative views showing how to detach the device of the present invention.
Figure 4C:
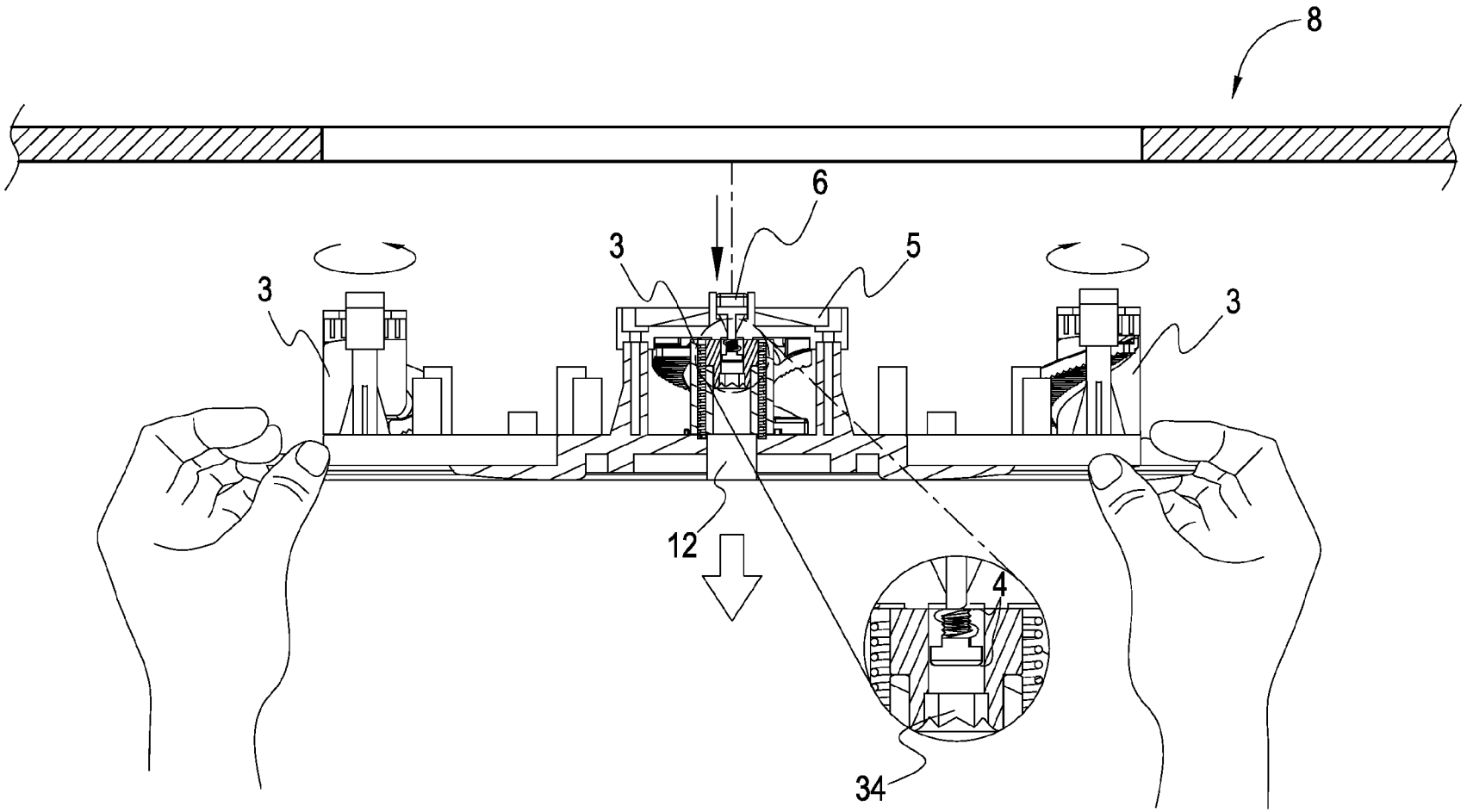
Figure 5A:
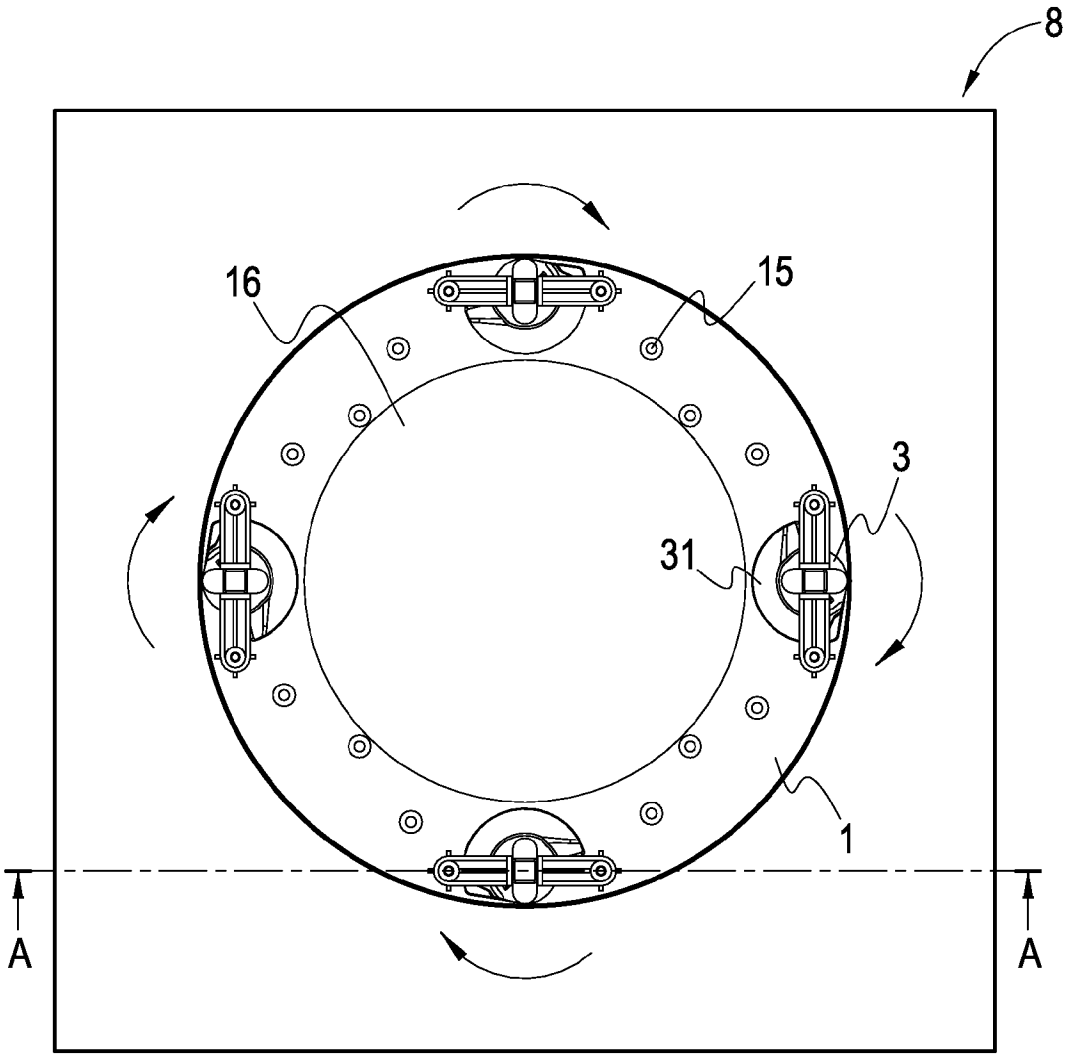
FIG. 5A is a top view showing detachment of the device according to the present invention.

Referring to FIG. 2, FIG. 3A through FIG. 3C, FIG. 5A and FIG. 5B, before installation, the gaiter 3 and the helical pawl 31 are put towards the central position as shown in FIG. 5A, then vertically put the device of the present invention at reserved position on the surface material 8 to upwardly fit the round terminal 71 of an angle shaped spanner 7 into the guide hole 12 of the hinge bracket 1 until reaching the guide hole 34 of the gaiter 3 as shown in FIG. 3 A and FIG. 3 C. Referring to FIG. 2, as the cushion spring 4 is formed of the compressed spring 41 coiled around the flat cap screw unit 42 passing upward through the gaiter 3 and the press fit 5 is fastened to the stop block 6, the pawl 61 of the stop block 6 will upwardly displace and be liberated from the notch 33 on the gaiter 3 when the spanner 7 pushes up the flat cap screw set 42 surrounded by the gaiter 3 with its round terminal 71 as shown on FIG. 3B. At this moment the gaiter 3 is untied and rapidly turned 180° by the coil spring 2 and held there by trapping the stopper 55 of the press fit 5 in the stopper 37 of the gaiter 3, and the helical pawl 31 of the gaiter 3 detains the surface material 8 forcibly with the frictional force between the grooves 35 formed at the bottom of the pawl 31 and the surface material 8. Further to this, with the aid of the cushion spring 4, the pawl 61 of the stop block 6 is then detained by the notch 33 of the gaiter 3. In this version the fastening of the surface material 8 with the gaiter 3 is accomplished as shown on FIG. 5B.

Referring to FIG. 4A, FIG. 4B, FIG. 4C, FIG. 5A and FIG. 5B, when detaching insert the hexagonal terminal 72 of the spanner 7 upwardly into the guide hole 12 of the hinge bracket 1 until reaching the guide hole 34 of the gaiter 3 so as to turn the gaiter 3 180° by applying torque to the guide hole 34, and liberate the pawl 61 from the notch 33 so as to release the surface material 8 from the detention of gaiter 3, and then with the aid of the cushion spring 4, the pawl 61 of the stop block 6 is then detained by the notch 33 of the gaiter 3. In this version the liberation of the surface material 8 from the detention of the gaiter 3 is accomplished as shown in FIG. 5A.

Referring to FIG. 2 and FIG. 3A, a recessed surface 36 is formed on each of the both sides of the notch 33 so as to guide the pawl 61 of the stop block 6 to a fixed position. The pawl 31 is made helical so as to enable it to hold the surface material 8 of different thickness. Meanwhile, the numbers of gaiter 3 can be adjusted according to the speaker size.

Figure 5B:
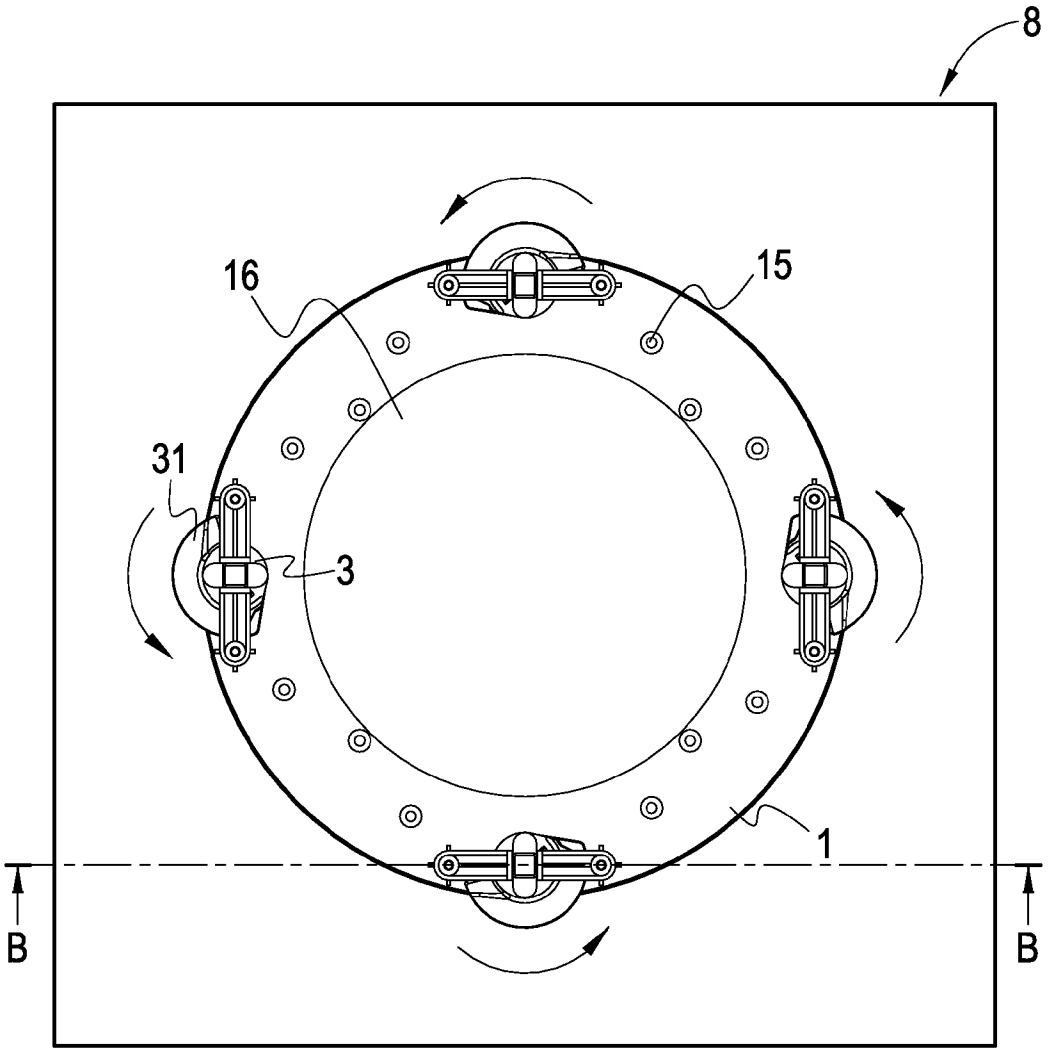
FIG. 5B is a top view showing installation of the device according to the present invention.

Referring to FIG. 5A and FIG. 5B, a speaker set pin 15 and a speaker containment hole 16 provided for the hinge bracket 1 enable the speaker of different shapes, sizes and weights that is below 15 kg to be installed and settled in the hinge bracket 1.

Figure 6B:
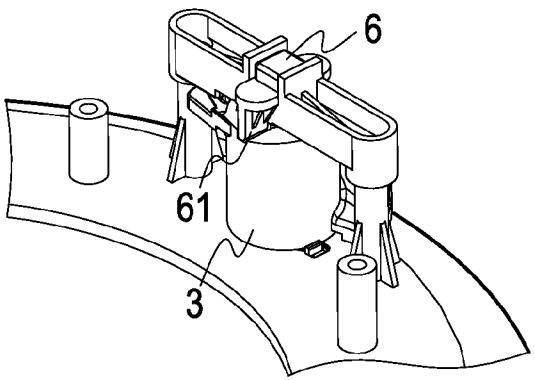
FIG. 6A and FIG. 6B are respectively an exploded view and an assembly view of the essential component parts of the device according to the present invention.
Figure 6A:
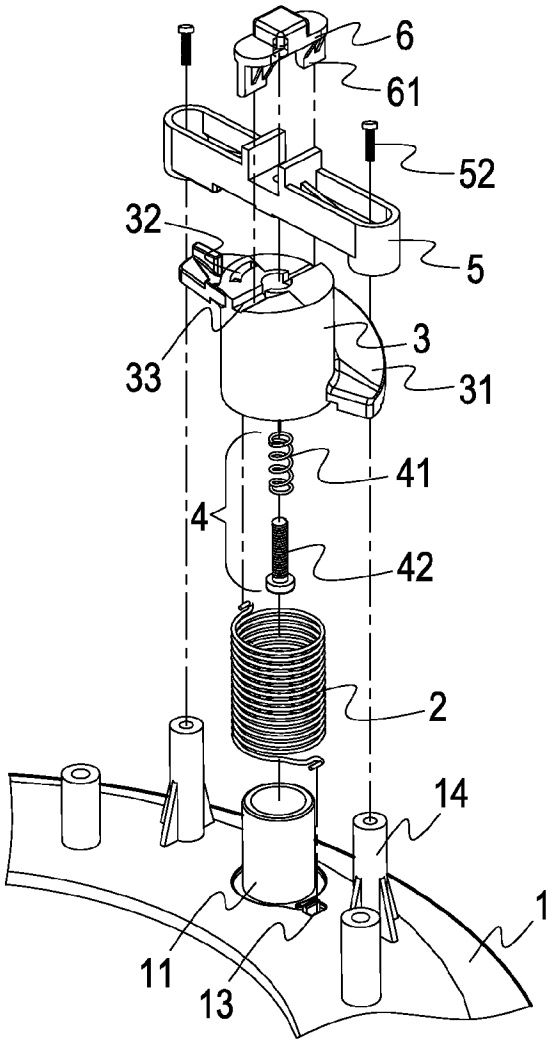

Referring to FIG. 6A and FIG. 6B, after the hinge bracket 1 is installed or detached, the pawl 61 of the stop block 6 is detained by the notch 33 of the gaiter 3 so as to control the gaiter 3 at its position. With such a tenon and mortise joint, the gaiter 3 may be stably held at its position after turning without being affected by the rotating torque of the coil spring 2.

Figure 7B:
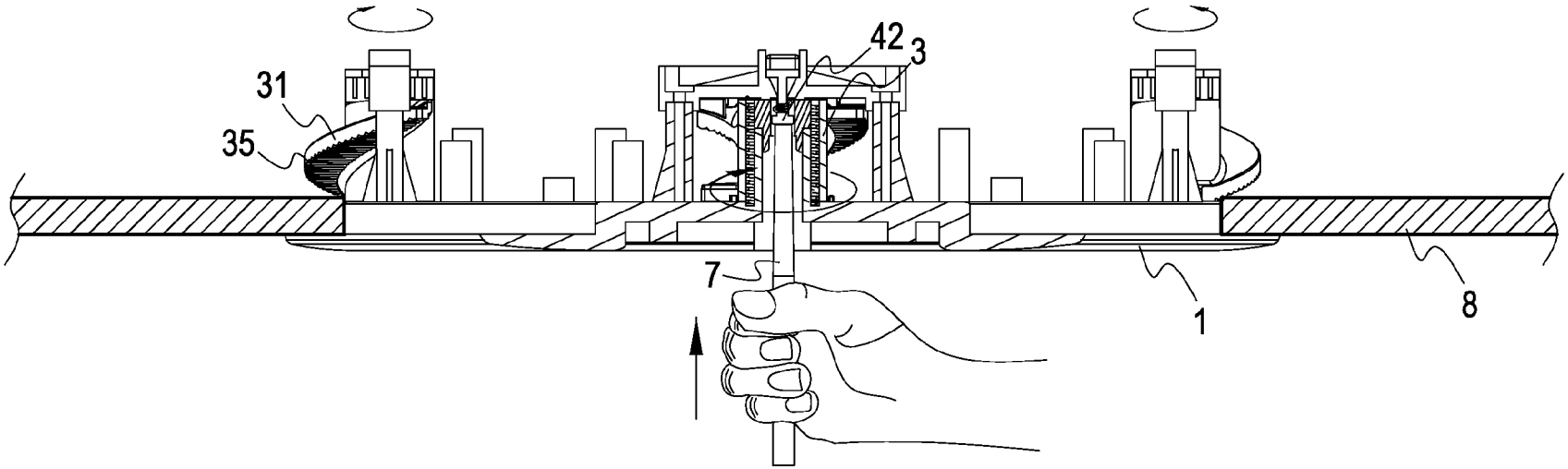

Referring to FIG. 7A and FIG. 7B, For installation of the hinge bracket 1, a pen holder, a piece of chop stick, and a screw driver or the like rod shaped tools are replaceable with the hexagonal angle shaped spanner 7 to operate the flat cap screw set 42 for rapidly turning the gaiter 3 to fasten the surface material 8.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. Rapid installation and detachment device for flush mounting speaker on ceiling or wall basically comprising:

a hinge bracket with several guide sleeve bases provided on the surface thereof, a detent groove formed at one side of each guide sleeve base, and several guide hole bases provided on the surface of said hinge bracket, wherein said hinge bracket is to carry the whole weight of the installation;

a coil spring sleeved over said guide sleeve base and secured to said detent groove of said hinge bracket with its one end, and to a detent groove of a gaiter with the other end thereof;

said gaiter being sleeved over said coil spring, and having a notch formed on the upper surface of said gaiter with a detent groove provided at said notch side, a pawl being secured to the exterior edge of said gaiter and a guide hole formed in said gaiter;

a press fit covered on said gaiter and having a tapped hole formed at each of the two sides thereof with a screw set passing through so as to hold said press fit at the position on the guide hole base of said hinge bracket, a notch being formed at the center surface of said press fit with a tapped hole for said press fit to pass through, and a pawl being provided at one bottom edge of said press fit;

a cushion spring formed of a flat cap screw set with a compressed spring coiled on it, wherein said cushion spring passes through said gaiter and said press fit up and down and then is secured to a stop block;

said stop block set on said notch of said press fit and having a tapped hole in it, and a pawl extended from lower edge of both sides thereof so as to form a tenon and mortise joint with said notch on the surface of said gaiter thereby controlling said gaiter at its position before starting turning motion;

with this structure said hinge bracket can be settled at the desired location with an angle shaped spanner to actuate said cushion spring thereby liberating said gaiter form detention of said stop block, and then grabbing the surface material by turning 180° with said coiled spring.

2. The device of claim 1, wherein a guide hole is provided in said guide sleeve base in said hinge bracket to let through said guide hole base.

3. The device of claim 1, wherein said pawl jointed to said gaiter is in helical shape to grab various surface materials with different thickness, a detent groove is formed at the upper end of said helical pawl to trap a stopper provided at the lower end of said press fit to control the motion of said device after starting to operate, said helical pawl is provided with several grooves on its bottom surface to enhance the frictional force when grabbing the surface material.

4. The device of claim 1, wherein said flat cap screw set can be unscrewed using a hexagonal spanner, after turning said pawl of said gaiter 180° to loosen it, said hinge bracket can be detached.

5. The device of claim 1, wherein the numbers of said gaiter can be adjusted according to the speaker size.

6. The device of claim 1, wherein said angle shaped spanner can be replaced with a pen holder, a piece of chop stick, a hexagonal spanner and the like rod shaped tool.

* * * * *